US009424780B2

(12) United States Patent
Wang

(10) Patent No.: US 9,424,780 B2
(45) Date of Patent: Aug. 23, 2016

(54) PIXEL CIRCUIT OF ACTIVE MATRIX ORGANIC LIGHT EMITTING DIODE, DRIVING METHOD OF THE SAME, AND DISPLAY APPARATUS

(71) Applicant: BOE TECHNOLOGY GROUP CO., LTD., Beijing (CN)

(72) Inventor: Ying Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 44 days.

(21) Appl. No.: 14/342,053

(22) PCT Filed: Jul. 31, 2013

(86) PCT No.: PCT/CN2013/080456
§ 371 (c)(1),
(2) Date: Feb. 28, 2014

(87) PCT Pub. No.: WO2014/176834
PCT Pub. Date: Nov. 6, 2014

(65) Prior Publication Data

US 2015/0035448 A1 Feb. 5, 2015

(30) Foreign Application Priority Data

Apr. 28, 2013 (CN) ..... 2013 1 0156300

(51) Int. Cl.
*G09G 3/30* (2006.01)
*G09G 3/32* (2016.01)
*G09G 3/10* (2006.01)

(52) U.S. Cl.
CPC ..... *G09G 3/3291* (2013.01); *G09G 3/3233* (2013.01); *G09G 2300/0819* (2013.01); *G09G 2300/0852* (2013.01); *G09G 2300/0861* (2013.01); *G09G 2320/0233* (2013.01)

(58) Field of Classification Search
CPC ... G09G 3/325; G09G 3/3291; G09G 3/3233
USPC ..... 345/76; 315/169.3
See application file for complete search history.

(56) References Cited

U.S. PATENT DOCUMENTS

2006/0114193 A1* 6/2006 Kwak ..... G09G 3/3233 345/76

(Continued)

FOREIGN PATENT DOCUMENTS

CN 101630481 A 1/2010
CN 102117598 A 7/2011

(Continued)

OTHER PUBLICATIONS

Written Opinion of the International Searching Authority dated Jan. 24, 2014; PCT/CN2013/080456.
First Chinese Office Action Appln. No. 201310156300.4; Dated Sep. 19, 2014.
International Search Report mailed Jan. 30, 2014; PCT/CN2013/080456.

*Primary Examiner* — Adam J Snyder
(74) *Attorney, Agent, or Firm* — Ladas & Parry LLP

(57) ABSTRACT

A pixel circuit, a driving method, and a display apparatus, wherein the pixel circuit includes: a first switch transistor having a source connected to a data signal terminal, and a gate connected to a first control signal terminal; a first capacitor having a first terminal connected to a drain of the first switch transistor; a second capacitor having a first terminal connected to a second voltage signal terminal, and a second terminal connected to a second terminal of the first capacitor; a third capacitor having a first terminal connected to the first control signal terminal, and a second terminal connected to a gate of a driving transistor; a second switch transistor having a source connected to the gate of the driving transistor, a drain connected to a drain of the driving transistor, and a gate connected to the first control signal terminal; and a third, fourth, fifth and sixth switch transistors.

15 Claims, 6 Drawing Sheets

(56) References Cited

U.S. PATENT DOCUMENTS

| | | | | |
|---|---|---|---|---|
| 2009/0201231 | A1* | 8/2009 | Takahara | G09G 3/3233 345/76 |
| 2009/0237332 | A1* | 9/2009 | Choi | G09G 3/325 345/76 |
| 2010/0220040 | A1* | 9/2010 | Kwak | G09G 3/3233 345/76 |
| 2011/0115764 | A1 | 5/2011 | Chung | |
| 2011/0157135 | A1 | 6/2011 | Lee et al. | |
| 2013/0314305 | A1 | 11/2013 | Liu et al. | |
| 2014/0132583 | A1* | 5/2014 | Kim | G09G 3/3233 345/76 |

FOREIGN PATENT DOCUMENTS

| | | | |
|---|---|---|---|
| CN | 102831859 | A | 12/2012 |
| CN | 102903333 | A | 1/2013 |
| CN | 102930824 | A | 2/2013 |
| CN | 203192370 | U | 9/2013 |
| KR | 20070115261 | A | 12/2007 |

* cited by examiner

PIXEL CIRCUIT OF ACTIVE MATRIX ORGANIC LIGHT EMITTING DIODE, DRIVING METHOD OF THE SAME, AND DISPLAY APPARATUS

TECHNICAL FIELD

The present disclosure relates to the art of a liquid crystal display technique, and particularly to a pixel circuit, a driving method for the same, and a display apparatus.

BACKGROUND

Compared to the Field Effect Thin Film Transistor (TFT) Liquid Crystal Display (LCD), the Active Matrix/Organic Light Emitting Diode (AMOLED) display as a novel display technique has many advantages in terms of view angle range, picture quality, efficiency, cost, and the like, and thus has a great potential for development in the field of a display production.

The active light-emitting diode display needs a higher driving current to achieve a perfect display effect since its light-emitting luminance is in a direct proportion to the driving current supplied to the OLED device, while the Low Temperature Poly-Silicon(LTPS) backboard technique is an optimum selection for the backboard technique of the AMOLED display since it can provide a higher mobility; nevertheless, the issue of the inherent threshold voltage drift in the low temperature poly-silicon technique causes the ununiformity in the driving current generated in the pixel circuit, and in turn raises a challenge of uniformity in the display luminance. Different driving voltages would generate different driving currents, resulting in the poor uniformity in the current, and thus the uniformity in the luminance is always poor.

The conventional 2T1C circuit as shown in FIG. 1 only comprises two TFTs, wherein T1 is a switch transistor and DTFT is a driving transistor for driving pixel; a scan line Scan turns on the switch transistor T1, and a data voltage Data charges a storage capacitor C; the switch transistor T1 is turned off during the period of light-emitting, and the voltage stored in the capacitor maintains the driving transistor DTFT to be turned on; the current flowing through the DTFT drives the OLED to emit light. In order to achieve a stable display, it is required that a stable current is supplied to the OLED. The voltage control circuit has advantages such as a simple structure, a fast speed for charging the capacitor, and the like, while the voltage control circuit has a disadvantage that it is difficult to perform a linear control on the driving current, since the uniformity in threshold voltage $V_{th}$ of DTFT is very poor due to the low temperature poly-silicon manufacturing process, and at the same time the threshold voltage $V_{th}$ also drifts; even if same technical parameters are used in the manufacture of the TFTs, there are large variations in the threshold voltages $V_{th}$ of the different TFTs, thus giving rise to the issues of poor uniformity in the light-emitting luminance and luminance attenuation in the driving circuit for light-emitting.

SUMMARY

In view of the above, the technical solutions of the present disclosure provides a pixel circuit, a driving method for the same, and a display apparatus so as to compensate for the uniformity of the threshold voltage $V_{th}$ of the driving transistor in the pixel circuit and address the issue of the poor uniformity in the light-emitting luminance of the light-emitting diode.

An embodiment of the present invention provides a pixel circuit comprises:

a light-emitting device having a first terminal connected to a first voltage signal terminal;

a driving transistor for driving the light-emitting device;

a first switch transistor having a source connected to a data signal terminal, and a gate connected to a first control signal terminal;

a first capacitor having a first terminal connected to a drain of the first switch transistor;

a second capacitor having a first terminal connected to a second voltage signal terminal, and a second terminal connected to a second terminal of the first capacitor;

a third capacitor having a first terminal connected to the first control signal terminal, and a second terminal connected to a gate of the driving transistor;

a second switch transistor having a source connected to the gate of the driving transistor, a drain connected to a drain of the driving transistor, and a gate connected to the first control signal terminal;

a third switch transistor having a source connected to the gate of the driving transistor and the second terminal of the first capacitor, a drain connected to a second control signal terminal, and a gate connected to a third control signal terminal;

a fourth switch transistor having a source connected to the drain of the driving transistor, a drain connected to a second terminal of the light-emitting device, and a gate connected to a fourth control signal terminal;

a fifth switch transistor having a source connected to the second voltage signal terminal, a drain connected to the source of the driving transistor, and a gate connected to the fourth control signal terminal; and a sixth switch transistor having a gate connected to the first control signal terminal, a source connected to the second terminal of the second capacitor, and a drain connected to the drain of the fifth switch transistor.

Optionally, in the above pixel circuit, the driving transistor, the first, second, third, fourth, fifth and sixth switch transistors are P-type Thin Film Field Effect transistors.

Optionally, in the above pixel circuit, the second control signal terminal is grounded.

Optionally, in the above pixel circuit, the light-emitting device is an Organic Light-Emitting Diode, and can be other type of light-emitting device.

An embodiment of the present invention further provides a display apparatus comprising the pixel circuit as described above.

An embodiment of the present invention provides a driving method for the above pixel circuit, wherein the driving method comprises:

during a first phase, turning on the third switch transistor, turning off the first switch transistor, the second switch transistor and the sixth switch transistor, so that the gate of the driving transistor is at the voltage output from the second control signal terminal;

during a second phase, turning off the third switch transistor, the fourth switch transistor and the fifth switch transistor, turning on the first switch transistor, the second switch transistor and the sixth switch transistor, so that the voltage output from the data signal terminal is transmitted to the gate of the driving transistor, the gate and the drain of the driving transistor are connected, and the driving transistor operates in a diode connection state; and during a third phase, turning off the first switch transistor, the second switch transistor, the third switch transistor and the sixth switch transistor, turning on the fourth switch transistor and the fifth switch transistor, maintaining the voltage at the gate of the driving transistor by the second capacitor, so that the driving transistor is turned on since it operates in a saturation state, and the light-emitting device emits light.

Optionally, in the above driving method, the driving transistor, the first, second, third, fourth, fifth and sixth switch transistors are P-type Thin Film Field Effect transistors.

Optionally, in the above driving method, during the first phase, the first control signal terminal and the data signal terminal output a high level respectively, and the third control signal terminal and the fourth control signal terminal output a low level respectively; during the second phase, the third control signal terminal and the fourth control signal terminal output a high level respectively, and the first control signal terminal and the data signal terminal output a low level respectively; and during the third phase, the first control signal terminal, the third control signal terminal and the data signal terminal output a high level, and the fourth control signal terminal outputs a low level.

Optionally, in the above driving method, the second control signal terminal is grounded during the first, second and third phases.

At least one of the technical solutions provided in the embodiments of the present invention has the following beneficial effects:

In the above pixel circuit and the driving method thereof, in the process of writing data during the second phase, the voltage value for the driving transistor has a relation to the voltage of the data writing signal, the voltage at the second control signal terminal, the voltage at the first control signal terminal, and the threshold voltage of the driving transistor, and is maintained by the second capacitor; during the third phase, the driving transistor operates in a saturation region, and since the voltage at the gate of the driving transistor is maintained by the second capacitor, the drain current of the driving transistor is independent of the threshold voltage $V_{th}$ of the driving transistor, so that the issue of the ununiformity in the driving current for the pixel due to the drift of the threshold voltage of the low temperature poly-silicon TFT can be addressed effectively, thus ensuring the uniformity of the display luminance.

DETAILED DESCRIPTION OF THE PREFERRED EMBODIMENTS

Figure 1:
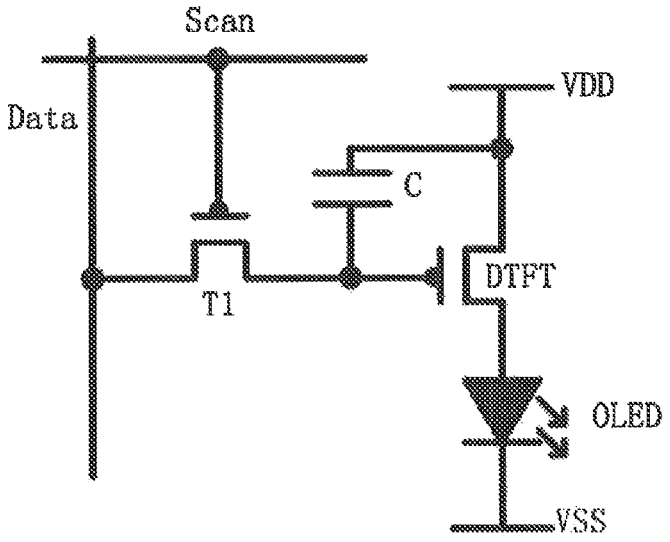
Fig.1 (Prior Art)
FIG. 1 is a schematic diagram illustrating a structure of a pixel circuit in the prior art.

To make the object, technical solution and advantageous of the present invention more clear, hereinafter, detailed descriptions will be made to the embodiments of the present invention in connection with the appended drawings. Obviously, the embodiments as described are only a part of the embodiments of the present invention, and are not all the embodiments of the present invention.

A pixel circuit according to an embodiment of the present invention comprises:

a light-emitting device having a first terminal connected to a first voltage signal terminal;

a driving transistor for driving the light-emitting device;

a first switch transistor having a source connected to a data signal terminal, and a gate connected to a first control signal terminal;

a first capacitor having a first terminal connected to a drain of the first switch transistor;

a second capacitor having a first terminal connected to a second voltage signal terminal, and a second terminal connected to a second terminal of the first capacitor;

a third capacitor having a first terminal connected to the first control signal terminal, and a second terminal connected to a gate of the driving transistor;

a second switch transistor having a source connected to the gate of the driving transistor, a drain connected to a drain of the driving transistor, and a gate connected to the first control signal terminal;

a third switch transistor having a source connected to the gate of the driving transistor and the second terminal of the first capacitor, a drain connected to a second control signal terminal, and a gate connected to a third control signal terminal;

a fourth switch transistor having a source connected to the drain of the driving transistor, a drain connected to a second terminal of the light-emitting device, and a gate connected to a fourth control signal terminal;

a fifth switch transistor having a source connected to the second voltage signal terminal, a drain connected to the source of the driving transistor, and a gate connected to the fourth control signal terminal; and a sixth switch transistor having a gate connected to the first control signal terminal, a source connected to the second terminal of the second capacitor, and a drain connected to the drain of the fifth switch transistor.

An embodiment of the present invention provides a driving method for the above pixel circuit, wherein the driving method comprises:

during a first phase, turning on the third switch transistor, turning off the first switch transistor, the second switch transistor and the sixth switch transistor, so that the gate of the driving transistor is at the voltage output from the second control signal terminal;

during a second phase, turning off the third switch transistor, the fourth switch transistor and the fifth switch transistor, turning on the first switch transistor, the second switch transistor and the sixth switch transistor, so that the voltage output from the data signal terminal is transmitted to the gate of the driving transistor, the gate and the drain of the driving transistor are connected, and the driving transistor operates in a diode connection state; and during a third phase, turning off the first switch transistor, the second switch transistor, the third switch transistor and the sixth switch transistor, turning on the fourth switch transistor and the fifth switch transistor, maintaining the voltage at the gate of the driving transistor by the second capacitor, so that the driving transistor is turned on since it operates in a saturation state, and the light-emitting device emits light.

Optionally, in the above pixel circuit and the driving method thereof, the driving transistor, the first, second, third, fourth, fifth and sixth switch transistors are P-type Thin Film Field Effect transistors.

Optionally, the second control signal terminal is grounded during the first, second and third phases; during the first phase, the first control signal terminal and the data signal terminal output a high level respectively, and the third control signal terminal and the fourth control signal terminal output a low level respectively; during the second phase, the third control signal terminal and the fourth control signal terminal output a high level respectively, and the first control signal terminal and the data signal terminal output a low level respectively; and during the third phase, the first control signal terminal, the third control signal terminal and the data signal terminal output a high level, and the fourth control signal terminal outputs a low level.

In the above pixel circuit and the driving method thereof, in the process of writing data during the second phase, the voltage value for the driving transistor has a relation to the voltage of the data writing signal, the voltage at the second control signal terminal, the voltage at the first control signal terminal, and the threshold voltage of the driving transistor, and is maintained by the second capacitor; during the third phase, the driving transistor operates in a saturation region, and since the voltage at the gate of the driving transistor is maintained by the second capacitor, the drain current of the driving transistor is independent of the threshold voltage $V_{th}$ of the driving transistor, so that the issue of the ununiformity in the driving current for the pixel due to the drift of the threshold voltage of the low temperature poly-silicon TFT can be addressed effectively, thus ensuring the uniformity of the display luminance.

Hereinafter, detailed descriptions will be given to the specific structure of the pixel circuit according to the embodiment of the present invention.

Figure 2:
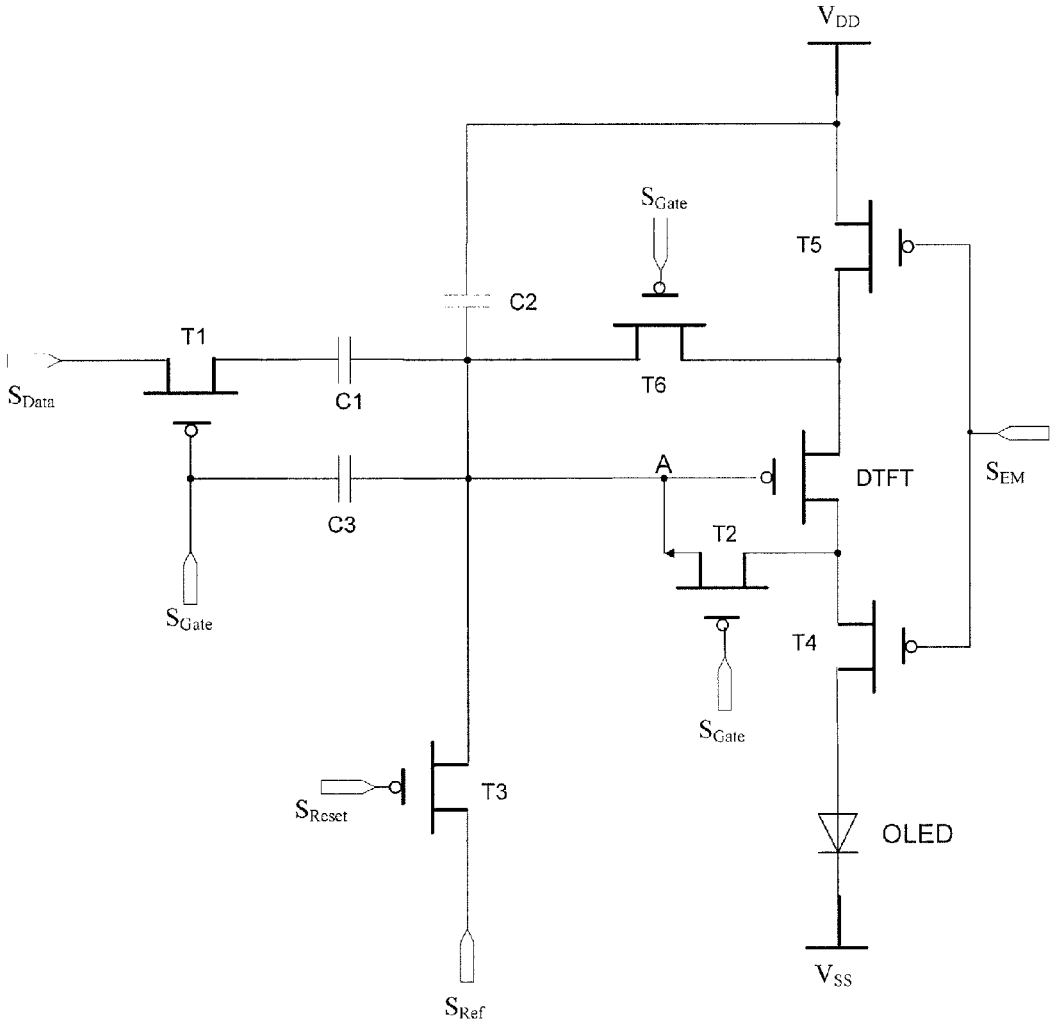
FIG. 2 is a schematic diagram illustrating a connection structure of a pixel circuit according to an embodiment of the present invention.

FIG. 2 is a schematic diagram illustrating the structure of the pixel circuit according to the embodiment of the present invention. As illustrated in FIG. 2, the structure of the pixel circuit according to the embodiment of the present invention comprises 7 TFTs and 3 capacitors C, and all the 7 TFTs are P-channel transistors, wherein T1~T6 are switch transistors, and DTFT is a driving transistor. Further, in the present embodiment, there are utilized a first control signal terminal $S_{Gate}$, a second control signal terminal $S_{Ref}$, a third control signal terminal $S_{Reset}$, a fourth control signal terminal $S_{EM}$, a data signal terminal $S_{Data}$, a first voltage signal terminal and a second voltage signal terminal; wherein, the first voltage signal terminal outputs a signal $V_{DD}$, the second voltage signal terminal outputs a signal $V_{SS}$, the control signal terminals $S_{Gate}$, $S_{Ref}$, and the data signal terminal $S_{data}$ output voltages $V_{Gate}$, $V_{Ref}$ and $V_{Data}$ respectively.

As shown in FIG. 2, a fifth switch transistor T5, a driving transistor DTFT, a fourth switch transistor T4 and a light-emitting device OLED are connected in series sequentially between the first voltage signal terminal and the second voltage signal terminal, wherein, the fifth switch transistor T5 has a gate connected to the fourth control signal terminal $S_{EM}$, and switches off or switches on the connection between the second voltage signal terminal and the source of the driving transistor DTFT in response to a voltage output from the fourth control signal terminal $S_{EM}$; the fourth switch transistor T4 has a gate also connected to the fourth control signal terminal $S_{EM}$, and switches off or switches on the connection between the drain of the driving transistor DTFT and the light-emitting device OLED in response to the voltage output from the fourth control signal terminal $S_{EM}$.

Additionally, the pixel circuit as shown in FIG. 2 further comprises:

a sixth switch transistor T6, a first capacitor C1 and a first switch transistor T1 in series sequentially arranged between the source of the driving transistor DTFT and the data signal terminal $S_{Data}$, wherein a gate of the sixth switch transistor T6 and a gate of the first switch transistor T1 are connected to the first control signal terminal $S_{Gate}$ respectively, and the sixth switch transistor T6 and the first switch transistor T1 are turned off or turned on in response to a voltage output from the first control signal terminal $S_{Gate}$; in particular, a source of the sixth switch transistor T6 is connected to the source of the driving transistor DTFT, a drain of the sixth switch transistor T6 is connected to a second terminal of the first capacitor C1; as shown in FIG. 2, and the source of the sixth switch transistor T6 is further connected to a second terminal of a second capacitor C2, and the drain of the sixth switch transistor T6 is further connected to the drain of the fifth switch transistor T5; a drain of the first switch transistor T1 is connected to a first terminal of the first capacitor C1, and a source of the first capacitor C1 is connected to the data signal terminal $S_{Data}$;

the second capacitor C2 having a first terminal connected to a second voltage signal terminal, and the second terminal connected to the second terminal of the first capacitor C1;

a third capacitor C3 having a first terminal connected to the first control signal terminal $S_{Gate}$, and a second terminal connected to the gate of the driving transistor DTFT;

a second switch transistor T2 having a source connected to the gate of the driving transistor DTFT, a drain connected to the drain of the driving transistor DTFT, and a gate connected to the first control signal terminal $S_{Gate}$, for disconnecting or connecting the gate and the drain of the driving transistor DTFT in response to the voltage output from the first control signal terminal $S_{Gate}$; and a third switch transistor T3 having a source connected to the gate of the driving transistor DTFT and the second terminal of the first capacitor C1, a drain connected to the second control signal terminal $S_{Ref}$, and a gate connected to the third control signal terminal $S_{Reset}$.

Specifically, the second control signal terminal $S_{Ref}$ can be grounded, that is, the output voltage $V_{Ref}$ is zero, and the first control signal terminal $S_{Gate}$ outputs a row scanning signal for the display panel.

Figure 3:
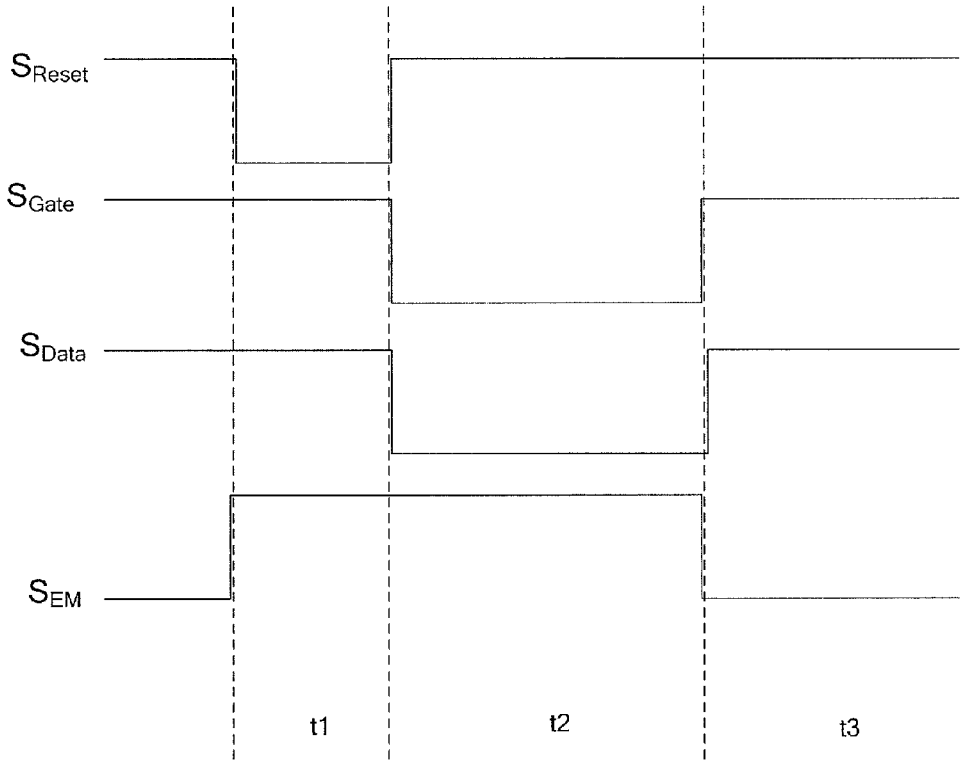
FIG. 3 is a timing diagram illustrating control signals in the pixel circuit according to the embodiment of the present invention.
Figure 4:
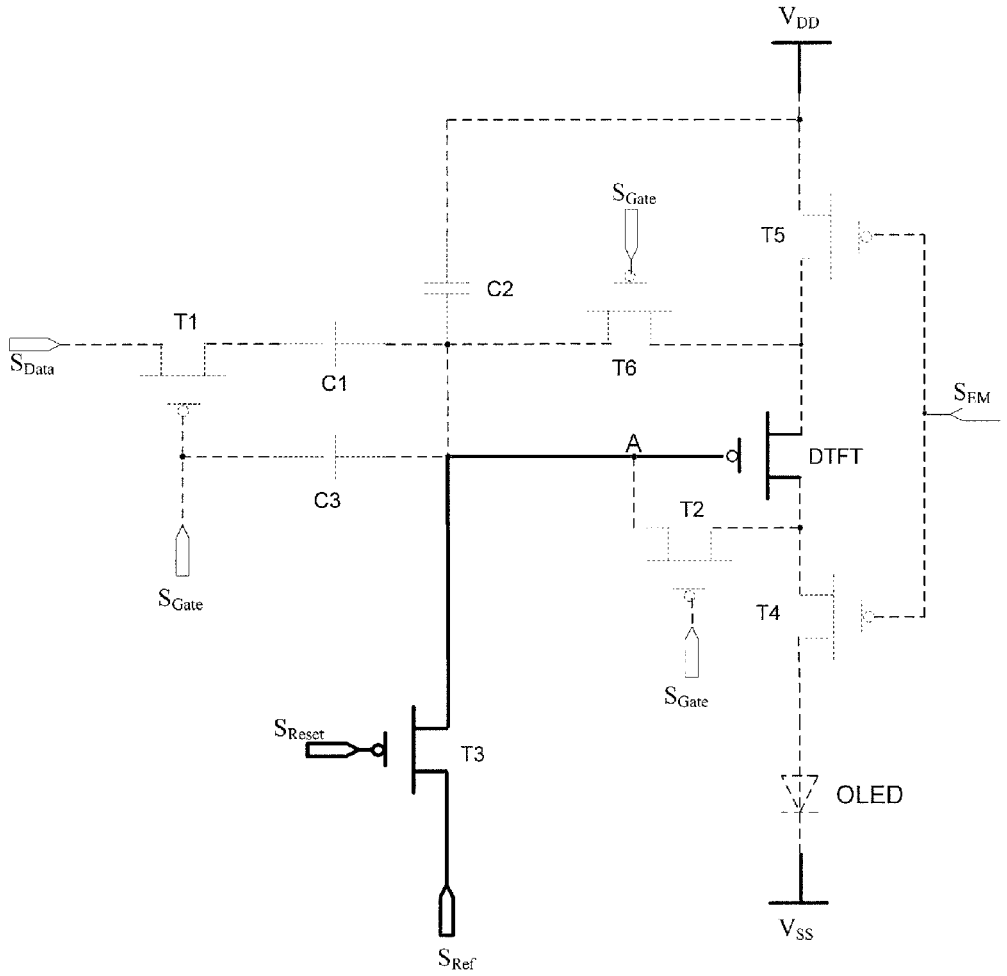
FIG. 4 is an equivalent circuit diagram of the pixel circuit according to the embodiment of the present invention during a first phase t1.
Figure 5:
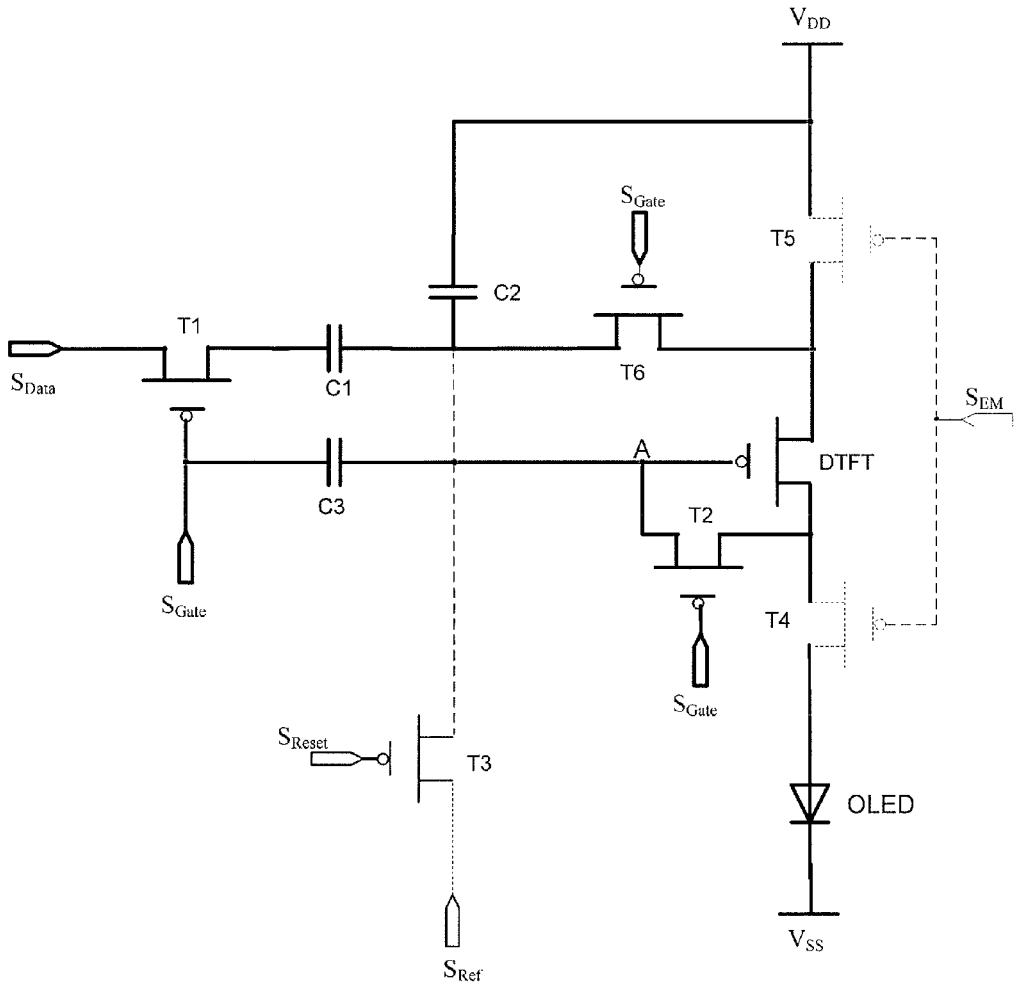
FIG. 5 is an equivalent circuit diagram of the pixel circuit according to the embodiment of the present invention during a first phase t2.
Figure 6:
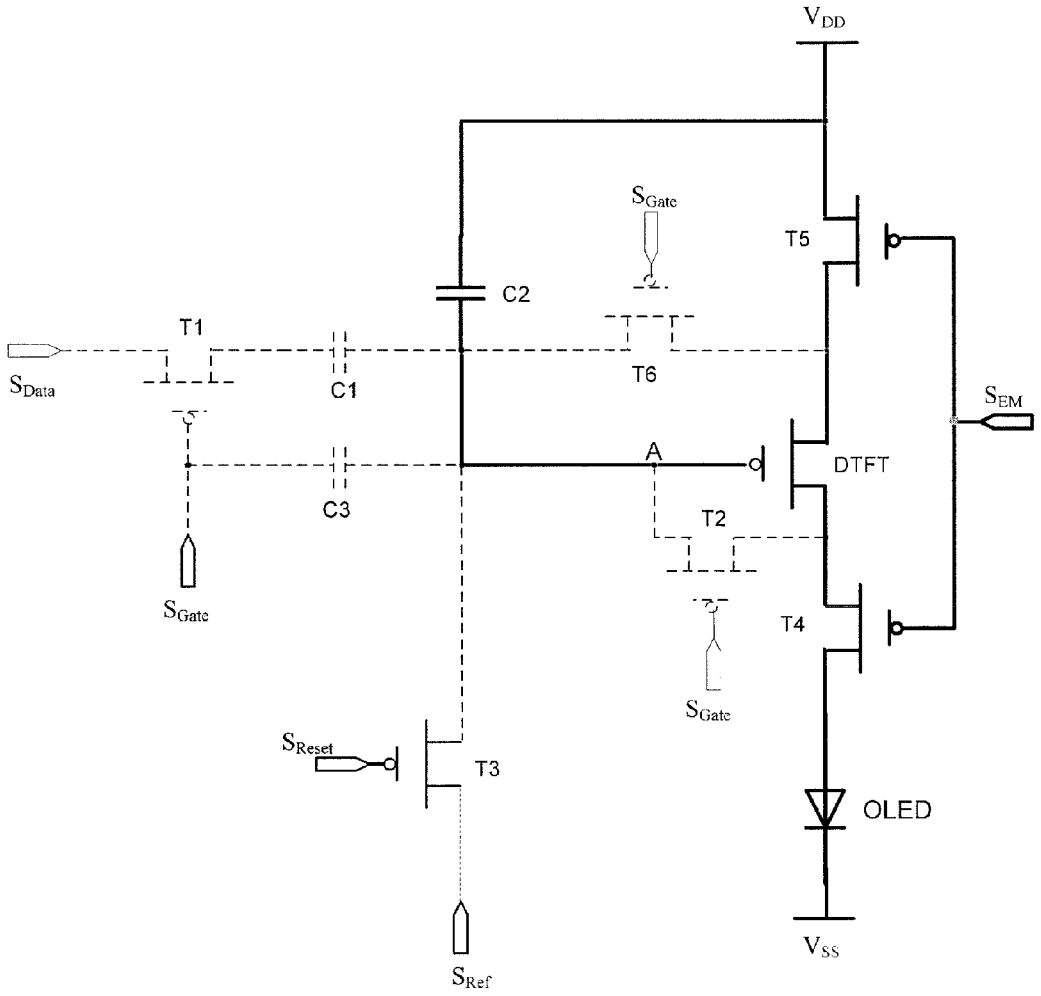
FIG. 6 is an equivalent circuit diagram of the pixel circuit according to the embodiment of the present invention during a third phase t3.

Next, detailed descriptions will be given to the operational procedures of the pixel circuit having the above structure according to the embodiments of the present invention with reference to FIGS. 3-6, wherein FIG. 3 is a timing diagram illustrating the control signals in the pixel circuit shown in FIG. 2, and FIGS. 4-6 are equivalent circuit diagrams of the pixel circuit during the first phase t1, the second phase t2 and the third phase t3.

The first phase t1 shown in FIG. 3 is an initial phase for the pixel circuit, wherein the third control signal terminal $S_{Reset}$ inputs a low level, so that the third switch transistor T3 is turned on in response to the low level output from the third control signal terminal $S_{Reset}$, and a voltage output from the second control signal terminal $S_{Ref}$ is written to a node A (i.e., the gate of the driving transistor), that is, to the point where the third switch transistor T3 and the second terminal of the third capacitor C3 are connected; at this time, the voltage at the second terminal of the first capacitor C1 and that at the second terminal of the third capacitor C3 are equal to the voltage $V_{Ref}$ output from the second control signal terminal $S_{Ref}$, thus completing the initialization for the pixel state. Simultaneously, during the first phase t1, the first control signal terminal $S_{Gate}$, the fourth control signal terminal $S_{EM}$ and the data signal terminal $S_{Data}$ output a high level, and the first switch transistor T1, the second switch transistor T2, the fifth switch transistor T5 and the sixth switch transistor T6 are turned off.

The second phase t2 shown in FIG. 3 is a writing phase for pixel data, and during the second phase t2, the voltage output from the third control signal terminal $S_{Reset}$ jumps from a low level to a high level, the third switch transistor T3 is turned off, and the voltage value $V_{Ref}$ output from the second control signal terminal $S_{Ref}$ is maintained by the second capacitor C2.

Simultaneously, by inputting data from the data signal terminal $S_{Data}$, the voltage output from the data signal terminal $S_{Data}$ is at a low level, and the first control signal terminal $S_{Gate}$ for outputting a row scan signal is also at a low level, so that the control signal is active and thus the first switch transistor T1 is turned on; the voltage output from the data signal terminal $S_{Data}$ is written to the pixel circuit, and at this time, the voltage at the gate of the driving transistor DTFT, i.e., at the node A, is equal to $(V_{Data}+V_{Ref}+V_{Gate})$.

Meanwhile, since the first control signal terminal $S_{Gate}$ is active, the second switch transistor T2 is turned on in response to the voltage output from the first control signal terminal $S_{Gate}$, at this time, the gate and the drain of the driving transistor DTFT are connected, forming a diode connection state, and the threshold voltage $V_{th}$ of the driving transistor DTFT is memorized and is maintained by the second capacitor C2. In view of the above, the voltage at the node A, that is, the voltage at the gate of the driving transistor DTFT is equal to $(V_{Data}+V_{Ref}+V_{Gate}-V_{th})$ and is stored in the second capacitor C2.

Further, during the second phase t2, the signal output from the fourth control signal terminal $S_{EM}$ is at a high level, thus ensuring that the fourth switch transistor T4 is turned off, so that the light-emitting state of the light-emitting device OLED can not be affected by the action of writing data to the pixel, avoiding flicker of the display. Simultaneously, the signal output from the fourth control signal terminal $S_{EM}$ is at a high level, which ensures that the fifth switch transistor T5 is turned off, thus guaranteeing that the source of the driving transistor DTFT is disconnected from the second voltage signal terminal, which avoids an adverse effect on the voltage at the gate of the driving transistor DTFT indirectly due to the leaking current of the driving transistor DTFT, since the leaking current between the source and the gate of the driving transistor DTFT is directly led to the gate thereof due to the existence of the diode connection state of the driving transistor DTFT, thus affecting the drain current of the driving transistor DTFT, i.e., the driving current for the light-emitting device OLED. On the other hand, in order to avoid the source of the driving transistor DTFT being floated, the sixth switch transistor T6 is turned on under the control of the signal output from the first control signal terminal $S_{Gate}$, so that the voltage at the node A is led to the source of the driving transistor DTFT; and in this case, even if there occurs a phenomenon of leaking current of the driving transistor DTFT, the gate voltage of the driving transistor DTFT is not affected and thus the leaking current of the driving transistor can not be affected.

The third phase t3 shown in FIG. 3 is a light-emitting phase for the light-emitting device OLED, and during the third phase t3, the signal output from the third control signal terminal $S_{Reset}$ is still at the high level, and the third switch transistor T3 is turned off; meanwhile, the data signal terminal $S_{Data}$ stops writing data and changes to be at a high level; the first control signal terminal $S_{Gate}$ jumps to be at a high level, and the first, second and sixth switch transistors T1, T2 and T6 are turned off; the voltage at the node A, i.e., at the gate of the driving transistor DTFT, $(V_{Data}+V_{Ref}+V_{Gate}-V_{th})$ is maintained by the second capacitor C2, and the voltage ensures that the driving transistor DTFT operates in a saturation region. Meanwhile, the signal output from the fourth control signal terminal $S_{EM}$ is at a low level, so that the fourth switch transistor T4 and the fifth switch transistor T5 are turned on, thus ensuring that the light-emitting device OLED emits light; and at this time, the drain current $I_d$ of the driving transistor DTFT is as follows:

$$\begin{aligned} Id &= \frac{1}{2}\mu Cox(W/L)(|V_{gs,DTFT}| - |V_{th}|)^2 \\ &= \frac{1}{2}\mu Cox(W/L)[V_{DD} - (V_{Data} + V_{Ref} + V_{Gate} - V_{th}) - V_{th}]^2 \\ &= \frac{1}{2}\mu Cox(W/L)(V_{DD} - V_{Data} - V_{Gate} - V_{Ref})^2 \end{aligned}$$

wherein $V_{gs,DTFT}$ represents the voltage between the gate and the source of the driving transistor DTFT, μ represents the mobility of the driving transistor DTFT, Cox(W/L) represents the capacitance of the isolation layer of the gate, W represent the width of the channel of the TFT, and L represents the length of the channel of the TFT.

It can be seen from the above equation that the drain current $I_d$ of the driving transistor DTFT is independent of the threshold voltage $V_{th}$, and thus the drift of the threshold voltage $V_{th}$ of the driving transistor DTFT would have no influence on the drain current of the driving transistor DTFT, i.e., the driving current of the pixel circuit.

In addition, optionally, the $V_{Ref}$ is grounded, and functions as resetting the potential at the node A; meanwhile, if there occurs a voltage drop at the second voltage signal terminal due to the wire resistance or parasitic resistance, i.e., IR drop, the value of the $V_{Ref}$ can be adjusted accordingly so that the voltage drop caused by the IR drop can be counteracted; at this time, the pixel circuit structure can also compensate for the fluctuation of the pixel current due to the IR drop of the power supply.

In addition, the third capacitor C3 is incorporated into the pixel circuit so as to raise the potential at the node A, i.e., the potential at the gate of the driving transistor DTFT, and thus provide a larger driving current; further, since the gate voltage of the driving transistor DTFT is increased, the response speed of the driving transistor DTFT is expedited accordingly. The capacitance value of the third capacitor C3 is very small, i.e., at the order of magnitude of 10 E-2 pF, thus occuping a small area in the layout, which does not affect the area of the whole layout for pixels.

In view of the above, the pixel circuit and the driving method for the same according to the embodiments of the present invention can not only compensate for the uniformity of the threshold voltage $V_{th}$ of the driving transistor and address the issue of the poor uniformity of the light-emitting luminance of the light-emitting diode, but also compensate for the fluctuation of pixels due to the IR drop of the power supply and expedite the response speed of the driving transistor DTFT.

In the pixel circuit provided in the embodiments of the present invention, all the switch transistors and the transistors are P-type TFT; optionally, all the switch transistors and transistors can be N-type TFTs, but the first voltage signal terminal outputs a voltage VDD, the second voltage signal terminal outputs a voltage VSS, the position of the OLED is changed so that the first terminal of the OLED is connected to the second voltage signal terminal and the second terminal of the OLED is connected to the source of the fifth switch transistor, and the voltage signals output from all the control signal terminals are adjusted accordingly since all the switch transistors are turned on when the gates thereof are supplied with a high level signal. Detailed operational principle is similar to that described as above and thus is omitted.

It should be noted that the switch transistors employed in the embodiments of the present invention are not limited to the Thin Film Field Effect Transistor having a gate, source and drain, and any switch device having the same function as the Thin Film Field Effect Transistor can work; and for the transistors utilized in the art of the liquid crystal display, there is no definite distinction between the source of the transistor and the drain thereof, and thus the source of the transistor defined in the embodiments of the present invention can be the drain thereof, and vise versa. Further, there is no definite distinction between the first terminal of the capacitor and the second terminal thereof, only for the purpose of describing the connection relationship of the capacitor clearly.

In another aspect, the embodiments of the present invention further provide a display apparatus comprising the above pixel circuit as described above in detail, and the details are omitted.

It should be appreciated that the above embodiments are only for illustrating the principle of the present disclosure, and in no way limit the scope of the present disclosure. It will be obvious that those skilled in the art may make modifications, variations and equivalences to the above embodiments without departing from the spirit and scope of the present disclosure as defined by the following claims. Such variations and modifications are intended to be included within the spirit and scope of the present disclosure.

What is claimed is:

1. A pixel circuit comprises:

a light-emitting device having a first terminal connected to a first voltage signal terminal;

a driving transistor for driving the light-emitting device;

a first switch transistor having a source connected to a data signal terminal, and a gate connected to a first control signal terminal;

a first capacitor having a first terminal connected to a drain of the first switch transistor;

a second capacitor having a first terminal connected to a second voltage signal terminal, and a second terminal connected to a second terminal of the first capacitor;

a third capacitor having a first terminal connected to the first control signal terminal, and a second terminal connected to a gate of the driving transistor, the second terminal of the first capacitor and the second terminal of the second capacitor;

a second switch transistor having a source connected to the gate of the driving transistor, a drain connected to a drain of the driving transistor, and a gate connected to the first control signal terminal;

a third switch transistor having a source connected to the gate of the driving transistor, the second terminal of the first capacitor, the second terminal of the second capacitor and the second terminal of the third capacitor, a drain connected to a second control signal terminal, and a gate connected to a third control signal terminal;

a fourth switch transistor having a source connected to the drain of the driving transistor, a drain connected to a second terminal of the light-emitting device, and a gate connected to a fourth control signal terminal;

a fifth switch transistor having a source connected to the second voltage signal terminal, a drain connected to a source of the driving transistor, and a gate connected to the fourth control signal terminal; and a sixth switch transistor having a gate connected to the first control signal terminal, a source connected to the second terminal of the second capacitor, and a drain connected to the drain of the fifth switch transistor and the source of the driving transistor.

2. The pixel circuit of claim 1, wherein, the driving transistor, the first, second, third, fourth, fifth and sixth switch transistors are P-type Thin Film Field Effect transistors.

3. The pixel circuit of claim 2, wherein, the first voltage signal terminal is at a low level, and the second voltage signal terminal is at a high level.

4. The pixel circuit of claim 1, wherein, the second control signal terminal is grounded.

5. The pixel circuit of claim 1, wherein the light-emitting device is an Organic Light-Emitting Diode.

6. A driving method for the pixel circuit of claim 1, wherein the driving method comprises:

during a first phase, turning on the third switch transistor, turning off the first switch transistor, the second switch transistor and the sixth switch transistor, so that the gate of the driving transistor is at the voltage output from the second control signal terminal;

during a second phase, turning off the third switch transistor, the fourth switch transistor and the fifth switch transistor, turning on the first switch transistor, the second switch transistor and the sixth switch transistor, so that the voltage output from the data signal terminal is transmitted to the gate of the driving transistor, the gate and the drain of the driving transistor are connected, and the driving transistor operates in a diode connection state; and during a third phase, turning off the first switch transistor, the second switch transistor, the third switch transistor and the sixth switch transistor, turning on the fourth switch transistor and the fifth switch transistor, maintaining the voltage at the gate of the driving transistor by the second capacitor, so that the driving transistor is turned on since it operates in a saturation state, and the light-emitting device emits light.

7. The driving method of claim 6, wherein the driving transistor, the first, second, third, fourth, fifth and sixth switch transistors are P-type Thin Film Field Effect transistors.

8. The driving method of claim 7, wherein the first voltage signal terminal is at a low level, and the second voltage signal terminal is at a high level.

9. The driving method of claim 7, wherein, during the first phase, the first control signal terminal, the fourth control signal terminal and the data signal terminal output a high level respectively, and the third control signal terminal outputs a low level; during the second phase, the third control signal terminal and the fourth control signal terminal output a high level respectively, and the first control signal terminal and the data signal terminal output a low level respectively; and during the third phase, the first control signal terminal, the third control signal terminal and the data signal terminal output a high level, and the fourth control signal terminal outputs a low level.

10. The driving method of claim 9, wherein the second control signal terminal is grounded during the first, second and third phases.

11. A display apparatus comprising a pixel circuit, the pixel circuit comprises:

a light-emitting device having a first terminal connected to a first voltage signal terminal;

a driving transistor for driving the light-emitting device;

a first switch transistor having a source connected to a data signal terminal, and a gate connected to a first control signal terminal;

a first capacitor having a first terminal connected to a drain of the first switch transistor;

a second capacitor having a first terminal connected to a second voltage signal terminal, and a second terminal connected to a second terminal of the first capacitor;

a third capacitor having a first terminal connected to the first control signal terminal, and a second terminal connected to a gate of the driving transistor, the second terminal of the first capacitor and the second terminal of the second capacitor;

a second switch transistor having a source connected to the gate of the driving transistor, a drain connected to a drain of the driving transistor, and a gate connected to the first control signal terminal;

a third switch transistor having a source connected to the gate of the driving transistor, the second terminal of the first capacitor, the second terminal of the second capacitor and the second terminal of the third capacitor, a drain connected to a second control signal terminal, and a gate connected to a third control signal terminal;

a fourth switch transistor having a source connected to the drain of the driving transistor, a drain connected to a second terminal of the light-emitting device, and a gate connected to a fourth control signal terminal;

a fifth switch transistor having a source connected to the second voltage signal terminal, a drain connected to a source of the driving transistor, and a gate connected to the fourth control signal terminal; and a sixth switch transistor having a gate connected to the first control signal terminal, a source connected to the second terminal of the second capacitor, and a drain connected to the drain of the fifth switch transistor and the source of the driving transistor.

12. The display apparatus of claim 11, wherein, the driving transistor, the first, second, third, fourth, fifth and sixth switch transistors are P-type Thin Film Field Effect transistors.

13. The display apparatus of claim 12, wherein, the first voltage signal terminal is at a low level, and the second voltage signal terminal is at a high level.

14. The display apparatus of claim 11, wherein, the second control signal terminal is grounded.

15. The display apparatus of claim 11, wherein the light-emitting device is an Organic Light-Emitting Diode.

* * * * *